United States Patent [19]

Egli

[11] 4,109,822

[45] Aug. 29, 1978

[54] PACKAGE COMPOSED OF AN INNER BAG ENCLOSED BY AN OUTER CONTAINER

[75] Inventor: Alwin Egli, Beringen, Switzerland

[73] Assignee: SIG Schweizerische Industrie-Gesellschaft, Neuhausen am Rheinfall, Switzerland

[21] Appl. No.: 723,491

[22] Filed: Sep. 15, 1976

[30] Foreign Application Priority Data

Sep. 23, 1975 [CH] Switzerland ..... 12348/75

[51] Int. Cl.[2] ..... B65D 5/60

[52] U.S. Cl. ..... 220/404; 206/611

[58] Field of Search ..... 229/14 B, 44 R, 51 TS; 220/404; 206/611

[56] References Cited

U.S. PATENT DOCUMENTS

| | | | |
|---|---|---|---|
| 3,078,026 | 2/1963 | Meinecke et al. | 229/14 B |
| 3,204,849 | 9/1965 | Vinnet | 229/14 B |
| 3,262,628 | 7/1966 | Heisler et al. | 229/14 B |
| 3,756,471 | 9/1973 | Wissman | 229/14 B |
| 3,944,127 | 3/1976 | Bruke et al. | 229/14 B |

FOREIGN PATENT DOCUMENTS

| | | | |
|---|---|---|---|
| 1,471,808 | 3/1967 | France | 229/14 B |

*Primary Examiner*—Stephen P. Garbe
*Attorney, Agent, or Firm*—Spencer & Kaye

[57] ABSTRACT

A package arranged to be opened at its top and composed of a flexible inner bag of sealable material having a flat sealed top, a jacket having a rectangular cross section and made of a stiff material, the jacket enclosing the bag and having an open end located at the top of the package and protruding beyond the flat sealed top of the bag, and a lid of stiff material having a flat portion of rectangular shape corresponding to the cross section of the jacket and adhesively secured to the flat bag top and bent edge strips joined to the flat portion and adhesively secured to the inner surfaces to the protruding portion of the jacket to join the inner bag and the jacket together.

4 Claims, 8 Drawing Figures

PACKAGE COMPOSED OF AN INNER BAG ENCLOSED BY AN OUTER CONTAINER

BACKGROUND OF THE INVENTION

The present invention relates to the production of a package of the type including an inner bag enclosed by an outer container of rectangular cross section, and particularly of the type in which the inner bag is made of a sealable foil and the outer container is made of a sheet or panel of a stiff material such as cardboard.

Such packages are used mainly for packaging substances in powder form, e.g. instant coffee, but they can also be used for packaging liquids or granular substances. In known packages of this type, the inner bag rests loosely inside the outer container. The bag has no stable shape and is rather unsightly if it has been sealed under vacuum, as is the custom for coffee. Such a bag does not lend itself to neat opening for removal of its contents. Once the bag has been opened it is practically impossible to effectively reclose it, with the result that the keeping qualities of the packaged product are impaired.

SUMMARY OF THE INVENTION

It is an object of the present invention to overcome these drawbacks.

This and other objects of the invention are achieved by forming a package of the above-described type to include, at its top, where it is to be opened, a lid insert provided with upwardly bent edge strips which are attached by means of adhesive to the inside of an end portion of the outer container, and, at its bottom, an edge zone which is glued to an upper seal of the package.

The objects of the invention are also achieved by a process for manufacturing such package, in which the sealable foil is placed around a mandrel having the form of a prism of rectangular cross section to form the inner bag, the upper sealed edge of the bag is formed by folding and sealing the foil, the outer container of the stiff foil is applied to the bag while it is being formed, upwardly bent edge strips and an edge zone of the lid insert are attached by means of adhesive to an end portion of the container or to the upper seal of the bag, the bag is filled from the bottom and thereupon the lower end of the bag as well as the lower end of the container are sealed.

DESCRIPTION OF THE PREFERRED EMBODIMENTS

Figures 1, 2, 3, 4, 5, 6:
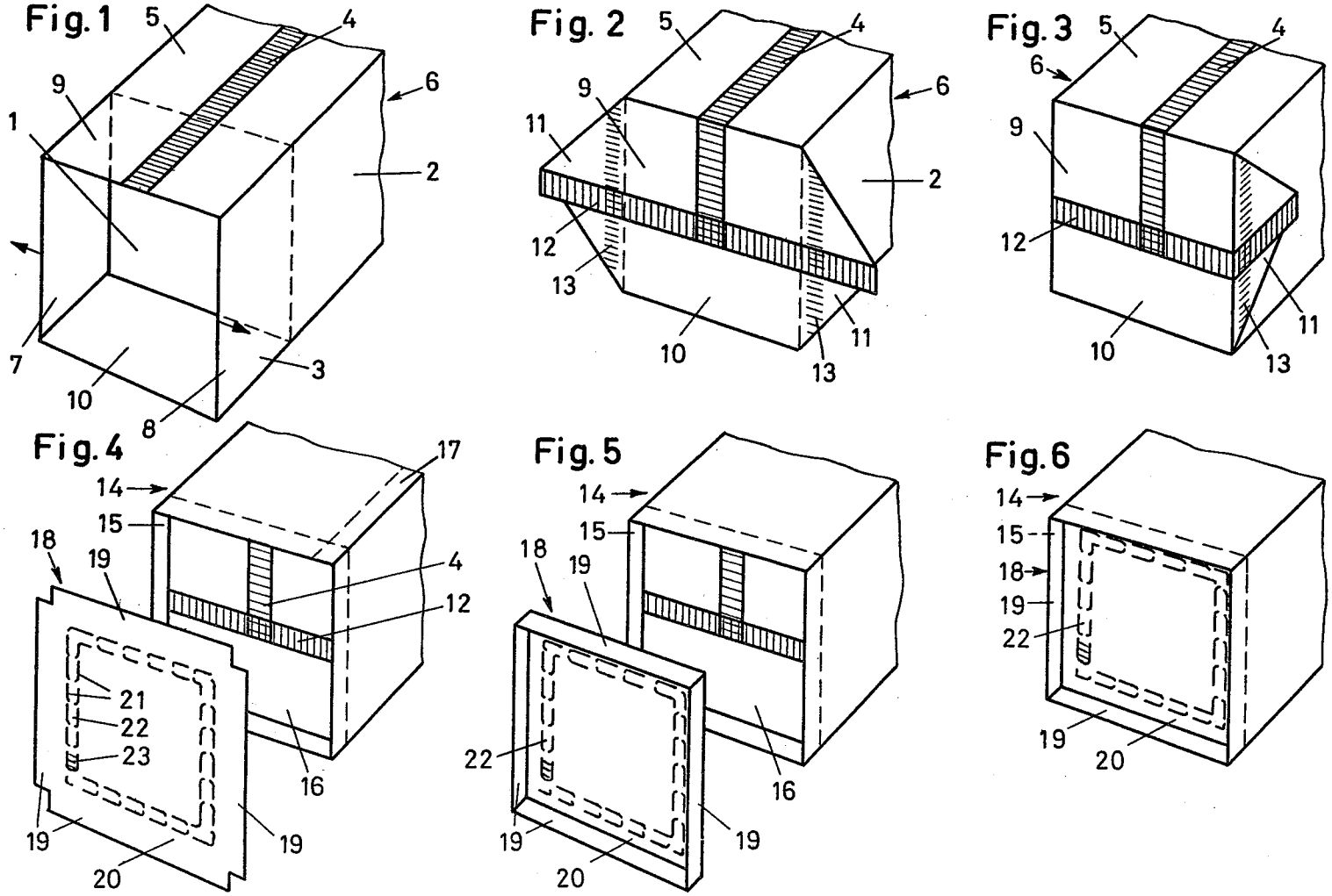
FIGS. 1–3 are perspective views of three successive phases in the sealing of the upper end of the inner bag of a package according to the present invention.
FIGS. 4–6 are perspective views of three successive phases in the sealing of the upper side of the outer container of the package according to the invention.

In FIG. 1, there can be seen the free frontal wall 1 of a mandrel in the form of a prism of rectangular, and particularly square, cross section. The mandrel which protrudes, for example, radially from a vertical axis of rotation of a package-making machine, has been encased, at a first process station of the machine, with a tubular length of sealable foil 2 having an end portion 3 which protrudes beyond frontal wall 1. The foil 2, which may be, for example, a thick, strong paper coated with a heat sealable plastic, may be formed about the mandrel in a known manner. It is also possible, however, to shape it into a tube of rectangular cross section and to push this onto the mandrel or to push a prefolded foil onto the mandrel and then complete folding.

A longitudinal seam 4 which connects the oppositely disposed longitudinal edges of foil 2 is produced by sealing means, e.g. welding jaws, provided at a second process station, and is then folded down onto the adjacent side surface 5 of the inner bag 6 being formed.

At further process stations the oppositely disposed walls 7 and 8 of the end portion 3 are pulled apart in the center as shown by the arrows. Consequently, the other two opposite walls 9 and 10 of edge portion 3 are folded in against frontal wall 1 and the outer ends of these walls come to lie one on the other, while the ends of the two halves of each wall 7 and 8 come to lie on top of one another, forming the folding corners 11 shown in FIG. 2. These edges are connected together by a sealed seam 12 which is folded into the plane of the thus formed upper seal of the inner bag 6. The two folded corners 11 are then sealed by two seal seams 13 and then folded down against the adjacent side surfaces of the bag, as shown. This forms the top end of the inner bag. The formation of a liquid or vacuum-tight seal in this type is known per se.

At a further process station, the jacket 14 of the outer container is, as shown in FIG. 4, applied over the inner bag 6. The free end 15 of jacket 14 is still open on the mandrel in such a manner that it protrudes by but a few millimeters beyond the plane of the sealed top end 16 of the inner bag. The jacket 14 is made of a sheet of stiff material, e.g. cardboard, capable of retaining its original shape. Two overlapping longitudinal edges of jacket 14 are attached to one another in a conventional manner by means of an adhesive, or are stapled together to form the longitudinal seam 17, which is delimited by a dashed line and a jacket edge.

Then, a square cardboard piece 18 initially having the form shown in FIG. 4, and provided with four protruding edge strips 19, has the edge strips bent upwardly to form the piece into an insertable lid having the form shown in FIG. 5. This lid is fitted into the free end 15 of jacket 14 and against the inner bag seal 16 in a further process station. The outside surfaces of edge strips 19 and a peripheral zone 20 on the underside of the insertable lid 18 have previously been coated with an adhesive, preferably of the hot melt type, which permanently fastens the insertable lid 18 to both the seal 16 of inner bag 6 and to the free end portion 15 of jacket 14 of the outer container.

The insertable lid 18 is provided, as indicated in FIG. 4, with two parallel weakened lines 21 formed, for example, of perforations, which define a tear strip 22 in the form of a square frame, preferably provided with a starting tab 23.

FIG. 6 shows the finished top end of the package, only jacket 14 with end portion 15 and insertable lid 18 and its opening tape 22 being visible. In this state the package is removed from the mandrel and placed down so as to rest on its finished upper end.

Figure 7:
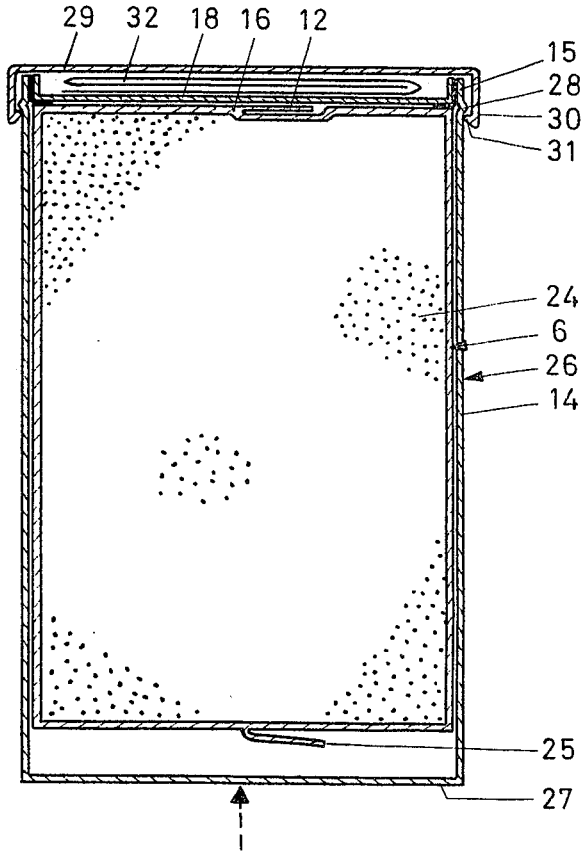
FIG. 7 is a cross-sectional elevational view of the completed package.

Now the inner bag 6 is filled, from the bottom, with the material 24 to be packaged, shown in FIG. 7, e.g. instant coffee, and is then sealed with bottom weld seams, preferably under vacuum. A bottom seam 25 may correspond in form, for example, to the seam 12 of the upper end seal 16. Then the outer container 26 is closed, likewise at its bottom 27, for example in the usual manner by folding down and gluing together the lower end flaps of jacket 14, which is not shown in the schematic representation of bottom 27. At the point of origin of the protruding end portion 15 of jacket 14 a small external bead 28 is provided which is not shown in FIGS. 4–6 and which serves to hold removable, square plastic lid 29 on the upper side of the outer container 26. Plastic lid 29 is provided with a downwardly extending resiliently yielding border 30 which at its lower edge is provided with an internal bead, or lip, 31 which, in the closed position of the lid, surrounds and grips outer bead 28. Between removable lid 29 and the inserted, permanently secured lid 18 there may be provided, if desired, a folded advertising leaflet 32 or the like.

Figure 8:
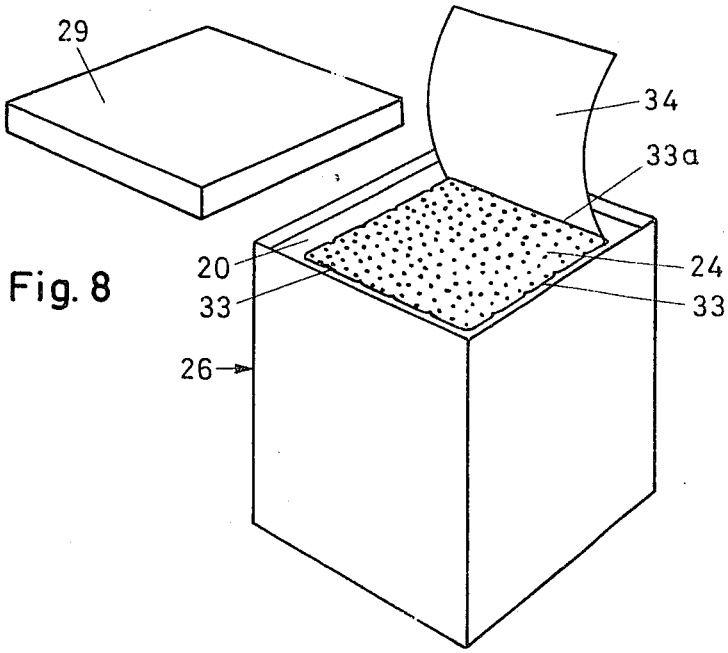
FIG. 8 is a perspective view of the package after it has been opened.

To open the package, lid 29 and leaflet 32 are removed and the tear strip 22 is pulled off so that the central main portion of the inserted lid 18 can be removed. Then, as shown in FIG. 8, the sealed top end 16 of the thin inner bag is cut through by means of a pointed knife along three sides 33 defined by the edge zones of the remaining part of inserted lid 18, top end 16 being connected to the edge zone 20 by means of adhesive, and finally the thus formed top flap 34 is folded about its fourth edge 33*a*. Upon removal of the desired quantity of packaged material 24, foil flap 34 is reclosed and lid 29 replaced on container 26.

Thus the package is tightly resealed so that there will be no significant loss of aroma from the instant coffee, for example.

As a result of the connection, at the opening end, of the inner bag 6 with the stiff outer container 26 by means of the insertable lid, the package retains its original outer shape during filling under vacuum as well as after opening. Any deformation of the bottom portion of the inner bag 6 in every case can not be seen.

The removable lid 29 need not necessarily be solid together with the body 6, 24, 26 of the package since it can be reused again and again by the user for resealing different packages.

A device for manufacturing inner bags and outer containers is disclosed, for example, in U.S. Pat. No. 3,373,663.

It will be understood that the above description of the present invention is susceptible to various modifications, changes and adaptations, and the same are intended to be comprehended within the meaning and range of equivalents of the appended claims.

What is claimed is:

1. A package arranged to be opened at its top and comprising: an inner bag having a flat top which is sealed, said inner bag being made of a sealable, flexible foil; an outer container of rectangular cross section enclosing said inner bag, said container including a jacket of stiff sheet material having an open end corresponding to the top of said package, and protruding beyond said flat top of said inner bag, and a lid insert of stiff sheet material positioned in such open end, said insert having a flat portion which bears against said flat top of said inner bag, said flat portion of said insert being coextensive with said flat top of said inner bag in order to completely cover said flat top, and edge strips located at the edges of said flat portion and extending away from said flat top of said inner bag at an angle to said flat central portion and bearing against the inner surfaces of the open end of said jacket; and adhesive means securing a peripheral region of said flat portion of said lid to said flat top of said inner bag and said edge strips to said protruding open end of said jacket, and wherein said flat portion of said lid insert is provided, inwardly of said peripheral zone, with at least one weakened line for permitting removal of an interior region of said flat portion.

2. An article as defined in claim 1 wherein there are two such weakened lines spaced from, and extending parallel to, one another to define a tear strip.

3. An article as defined in claim 1 further comprising a second, removable lid formed to be placed onto the end of said jacket at the top of said package and carrying means for elastically and removably securing said second lid to the top of said package.

4. An article as defined in claim 3 wherein said second lid is formed to define, when secured to the top of said package, a space with said first-recited lid for holding advertising material.

* * * * *